US009481078B2

(12) United States Patent
Maltais et al.

(10) Patent No.: US 9,481,078 B2
(45) Date of Patent: Nov. 1, 2016

(54) NAILER FOR HARDWOOD FLOORING

(71) Applicant: Laboratoire Primatech Inc., Quebec, Quebec (CA)

(72) Inventors: Jacques Maltais, Quebec (CA); David Lavoie, Quebec (CA)

(73) Assignee: LABORATOIRE PRIMATECH INC., Quebec (CA)

( * ) Notice: Subject to any disclaimer, the term of this patent is extended or adjusted under 35 U.S.C. 154(b) by 471 days.

(21) Appl. No.: 14/156,751

(22) Filed: Jan. 16, 2014

(65) Prior Publication Data

US 2015/0197000 A1 Jul. 16, 2015

(51) Int. Cl.

| | |
|---|---|
| ***B25C 1/02*** | (2006.01) |
| ***B25C 5/02*** | (2006.01) |
| ***B25C 5/00*** | (2006.01) |

(52) U.S. Cl.

CPC . *B25C 1/02* (2013.01); *B25C 5/00* (2013.01); *B25C 5/02* (2013.01); *B25C 5/0257* (2013.01)

(58) Field of Classification Search

CPC ..... B25C 5/00; B25C 5/02; B25C 5/0257; B25C 5/15; B25C 5/04; B25C 1/00; B25C 1/02; B25C 1/04

USPC ..... 227/119, 109, 145, 148, 139

See application file for complete search history.

(56) References Cited

U.S. PATENT DOCUMENTS 1,955,467 A * 4/1934 Morgan ..... B27F 7/02 227/145
3,820,705 A * 6/1974 Beals ..... B25C 1/005 227/110
3,945,414 A 3/1976 Gordon
3,952,935 A * 4/1976 Erkenbrack ..... B25C 1/00 206/343
4,013,207 A * 3/1977 ErkenBrack ..... B25C 1/00 227/120
4,349,143 A 9/1982 Ewig
4,410,125 A * 10/1983 Noiles ..... A61B 17/0684 227/145
4,491,262 A * 1/1985 Ewig ..... B25C 5/15 227/110
4,645,111 A * 2/1987 Larrabee ..... A61B 17/0684 227/120

(Continued)

FOREIGN PATENT DOCUMENTS

DE 19530244 A1 2/1997

*Primary Examiner* — Scott A. Smith

(74) *Attorney, Agent, or Firm* — Fraser Clemens Martin & Miller LLC; James D. Miller

(57) ABSTRACT

A nailer is provided for securing planks to a subfloor in tight places with fasteners. A fastener ejection channel made in the nailer is formed in between a pair of first and second guide plates spacedly mounted parallel to one another. The first guide plate defines a planar inner end portion having an ovoidal slot and an outer end portion defining a transverse arcuate first flange. The second guide plate defines an arcuate second flange extending away from the first guide plate and generally parallel to the first flange. An elongated straight push rod is mounted partially nested at an inner end in the ovoidal slot. The bottom portion of the push rod is movable along the fastener ejection channel between first and second limit positions. A lengthwise notch extends along the second guide plate intermediate section and opens into the second flange and is sized and shaped to accommodate transverse passage of an outer end portion of the push rod, wherein the push rod moves rectilinearly between the first and an intermediate position thereof but the push rod outer end portion tilts laterally away from the first guide plate when moving in non-rectilinear fashion between the intermediate and second limit positions thereof.

7 Claims, 16 Drawing Sheets

(56) References Cited

U.S. PATENT DOCUMENTS 4,699,307 A * 10/1987 Kozyrski ..... B25C 1/02 227/109
4,858,813 A 8/1989 Wingert
5,231,750 A 8/1993 Fealey
5,605,270 A * 2/1997 Dunn ..... B27F 7/006 227/140
6,123,245 A 9/2000 Maltais
6,481,612 B1 * 11/2002 Mangone, Jr. ..... B25C 5/00 227/130
6,783,051 B2 8/2004 Kozyrski
7,303,105 B2 12/2007 Dion et al.
8,104,659 B2 * 1/2012 St. John ..... B25C 1/008 227/131
8,469,251 B2 * 6/2013 Clark ..... B25C 3/006 227/119

* cited by examiner

NAILER FOR HARDWOOD FLOORING

FIELD OF THE INVENTION

The present invention relates to fastener driving tools, and more particularly to a nailing device for driving fasteners through hardwood planks in tight corners in order to secure them to a subfloor.

BACKGROUND OF THE INVENTION

Hardwood flooring generally consists of a number of elongated tongue-and-groove type planks individually fitted close to one another and then fastened in position to a subjacent subfloor. To fasten these hardwood planks to the subfloor of a room composed for example of plywood plates or floor joists, it is known to manually use a mallet-operated nailer. Such a nailer generally comprises a main body with a floor-engageable flat shoe mounted to its bottom surface, upon which the tool rests against a hardwood plank prior to discharging a fastener in the latter. Such a nailer also comprises a magazine holding fasteners such as straight metallic L- or T-shaped barbed straight cleats or U-shaped straight staples, and feeding them to a fastener discharge mechanism. With such manual nailers, to fasten a hardwood plank to the subfloor, a workman has to lay the nailer onto a hardwood plank, and then use a mallet to strike an anvil member of the fastener discharge mechanism. When a mallet strikes the anvil member of the tool, a straight and elongated plunger of the fastener discharge mechanism is axially actuated to strike a cleat held in the magazine, this cleat being then forcibly ejected out of the tool.

In order to hide the nail heads, some nailers drive the fasteners through the plank and into the subfloor in an oblique direction, as opposed to being driven in the planks vertically. This is called "blind nailing".

However, known nailers driving fasteners in an oblique fashion in hardwood planks reach with difficulty areas very close to upright walls. The hardwood planks located parallel to an upright wall in closely spaced fashion cannot be anchored to the subfloor using such nailers, and the fasteners must instead be driven vertically, e.g. using a manual hammer and nail, into the hardwood plank edge portions adjacent to walls.

The invention described in applicant's U.S. Pat. No. 7,303,105 issued Dec. 4, 2007 relates to a nailer for hardwood flooring capable of working directly against an upright wall, but is limited to fasteners being originally arcuate in shape to start with. One drawback of this prior art patent was complexity of its operating mechanism.

A problem with conventional pneumatic nailers is that their nail driver rod must necessarily follow an axially aligned travel path for 100% of their travelling direction, due to the limitation of the straight nailer guide plates. This is a drawback when using straight nails with a nailer, very close to or against an upright wall or other obstacle over the work surface.

SUMMARY OF THE INVENTION

In one embodiment of the invention, a nailer is provided for securing planks to a subfloor or other structure in tight places using fasteners, said nailer comprising: a main body defining a fastener discharge mouth; fastener ejection means operatively mounted in said nailer main body for accommodating passage of a fastener, the fastener having a head at one end and an opposite tip, said fastener ejection means opening outwardly of said nailer at said fastener discharge mouth; an elongated straight push rod, defining an inner end thereof operatively mounted to said fastener ejection means, and defining an outer end portion thereof for freely axially engaging the fastener head, said push rod movable between first and second limit positions, including an intermediate position between said first and second limit positions; wherein said push rod moves rectilinearly between said first and intermediate positions thereof but said push rod outer end portion tilts laterally away when moving in a non-rectilinear fashion between said intermediate and second limit positions thereof; and a plunger actuator nested in said main body and operatively connected to said inner end portion of said push rod, wherein said plunger actuator can be selectively activated for moving said push rod between its said first and second limit positions; wherein upon activation of said plunger actuator, said push rod will move along said fastener ejection means from said first limit position towards said second limit position to forcibly strike the fastener head, wherein between said intermediate position and said second limit position, the push rod outer end portion will be ejected out of said nailer through said fastener discharge mouth and into a subjacent workpiece.

In one embodiment, said fastener ejection means could consist of a fastener ejection channel made in said nailer main body, said fastener ejection channel being formed in between a pair of first and second registering guide plates spacedly mounted parallel to one another for accommodating therebetween passage of a fastener, said first guide plate defining a planar first intermediate section and a planar inner end portion having a lengthwise slider mounting means and an outer end portion defining an arcuate first flange crossing the plane of said first intermediate section, said second guide plate defining a planar second intermediate section having an outer end portion defining an arcuate second flange crossing the plane of said first main body away from said first guide plate and generally parallel to said first flange; said elongated straight push rod, partially nested at an inner end thereof in said fastener ejection channel slider mounting means, said push rod movable along said fastener ejection channel between first and second limit positions; a lengthwise notch further extending along said second guide plate intermediate section and opening into said second flange and sized and shaped to accommodate transverse passage of said outer end portion of said push rod, wherein said push rod outer end portion tilts laterally away from said first guide plate when moving in said non-rectilinear fashion between said intermediate and second limit positions thereof; wherein upon activation of said plunger actuator, the push rod outer end portion will become laterally dynamically deflected by said first flange transversely of the plane of said first guide plate intermediate section and will move through said second guide plate notch and biasing the fastener to escape through said fastener discharge mouth to be ejected out of said nailer through said fastener discharge mouth and into a subjacent workpiece. Said slider mounting means could then define an ovoidal slot made into said first intermediate section of said first guide plate, and a slider carriage operatively slidingly mounting said push rod inner end for relative movement to said ovoidal slot.

In another embodiment of the invention, there is disclosed a nailer for securing planks to a subfloor or other structure in tight places using fasteners, said nailer comprising: a main body defining a fastener discharge mouth; a fastener ejection channel made in said nailer main body, said fastener ejection channel being formed in between a pair of first and second registering guide plates spacedly mounted parallel to one another for accommodating therebetween passage of a fastener, the fastener having a head at one end and an opposite tip, said fastener ejection channel opening outwardly of said nailer at said fastener discharge mouth, said first guide plate defining a planar first intermediate section and a planar inner end portion having a lengthwise slider mounting means and an outer end portion defining an arcuate first flange crossing the plane of said first intermediate section, said second guide plate defining a planar second intermediate section having an outer end portion defining an arcuate second flange crossing the plane of said first main body away from said first guide plate and generally parallel to said first flange; fastener push means, for freely axially engaging the fastener head, and a plunger actuator nested in said main body and operatively connected to said fastener push means; wherein upon activation of said plunger actuator, said fastener push means will bias the fastener to escape through said fastener discharge mouth to be ejected out of said nailer through said fastener discharge mouth and into a subjacent workpiece.

In this latter embodiment, said fastener push means could then consist of an elongated straight push rod, partially nested at an inner end thereof in said fastener ejection channel slider mounting means, and defining an outer end portion thereof for freely axially engaging the fastener head, said push rod movable along said fastener ejection channel between first and second limit positions, including an intermediate position between said first and second limit positions; a lengthwise notch further extending along said second guide plate intermediate section and opening into said second flange and sized and shaped to accommodate transverse passage of said outer end portion of said push rod, wherein said push rod moves rectilinearly between said first and intermediate positions thereof but said push rod outer end portion tilts laterally away from said first guide plate when moving in non-rectilinear fashion between said intermediate and second limit positions thereof; said plunger actuator nested in said main body being operatively connected to said inner end portion of said push rod, wherein said plunger can be selectively activated for moving said push rod between its said first and second limit positions; wherein upon activation of said plunger actuator, said push rod will move along said fastener ejection channel from said first limit position towards said second limit position to forcibly strike the fastener head, wherein between said intermediate position and said second limit position, the push rod outer end portion will become laterally dynamically deflected by said first flange transversely of the plane of said first guide plate intermediate section and will move through said second guide plate notch and biasing the fastener to escape through said fastener discharge mouth to be ejected out of said nailer through said fastener discharge mouth and into a subjacent workpiece. Said slider mounting means could then define an ovoidal slot made into said first intermediate section of said first guide plate, and a slider carriage operatively slidingly mounting said push rod inner end for relative movement to said ovoidal slot.

In still another embodiment of the invention, there is disclosed use of a nailer for securing hardwood flooring planks to a subfloor in tight places using fasteners, said nailer comprising: a main body defining a fastener discharge mouth; a fastener ejection channel made in said nailer main body, said fastener ejection channel being formed in between a pair of first and second registering guide plates spacedly mounted parallel to one another for accommodating therebetween passage of a fastener, the fastener having a head at one end and an opposite tip, said fastener ejection channel opening outwardly of said nailer at said fastener discharge mouth, said first guide plate defining a planar first intermediate section and a planar inner end portion having a lengthwise slider mounting means and an outer end portion defining an arcuate first flange crossing the plane of said first intermediate section, said second guide plate defining a planar second intermediate section having an outer end portion defining an arcuate second flange crossing the plane of said first main body away from said first guide plate and generally parallel to said first flange; an elongated straight push rod, partially nested at an inner end thereof in said fastener ejection channel slider mounting means, and defining an outer end portion thereof for freely axially engaging the fastener head, said push rod movable along said fastener ejection channel between first and second limit positions, including an intermediate position between said first and second limit positions; a lengthwise notch further extending along said second guide plate intermediate section and opening into said second flange and sized and shaped to accommodate transverse passage of said outer end portion of said push rod, wherein said push rod moves rectilinearly between said first and intermediate positions thereof but said push rod outer end portion tilts laterally away from said first guide plate when moving in non-rectilinear fashion between said intermediate and second limit positions thereof; and a plunger actuator nested in said main body and operatively connected to said inner end portion of said push rod and movable along an axial channel defining a direction of displacement thereof, wherein upon actuation of said plunger actuator, said plunger actuator moves said push rod between its said first and second limit positions and said push rod forcibly strikes the fastener head, wherein between said intermediate position and said second limit position, the push rod outer end portion becomes laterally dynamically deflected by said first flange transversely of the plane of said first guide plate intermediate section and moves through said second guide plate notch and biases the fastener to escape through said fastener discharge mouth to be ejected out of said nailer through said fastener discharge mouth and into a subjacent workpiece.

In this latter embodiment, said fastener could be ejected through said fastener ejection channel in a direction diverging from said axial channel direction of displacement of said plunger actuator.

One general feature of the present invention is the simplicity in the manufacturing process of the nailer.

BRIEF DESCRIPTION OF THE DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 14:
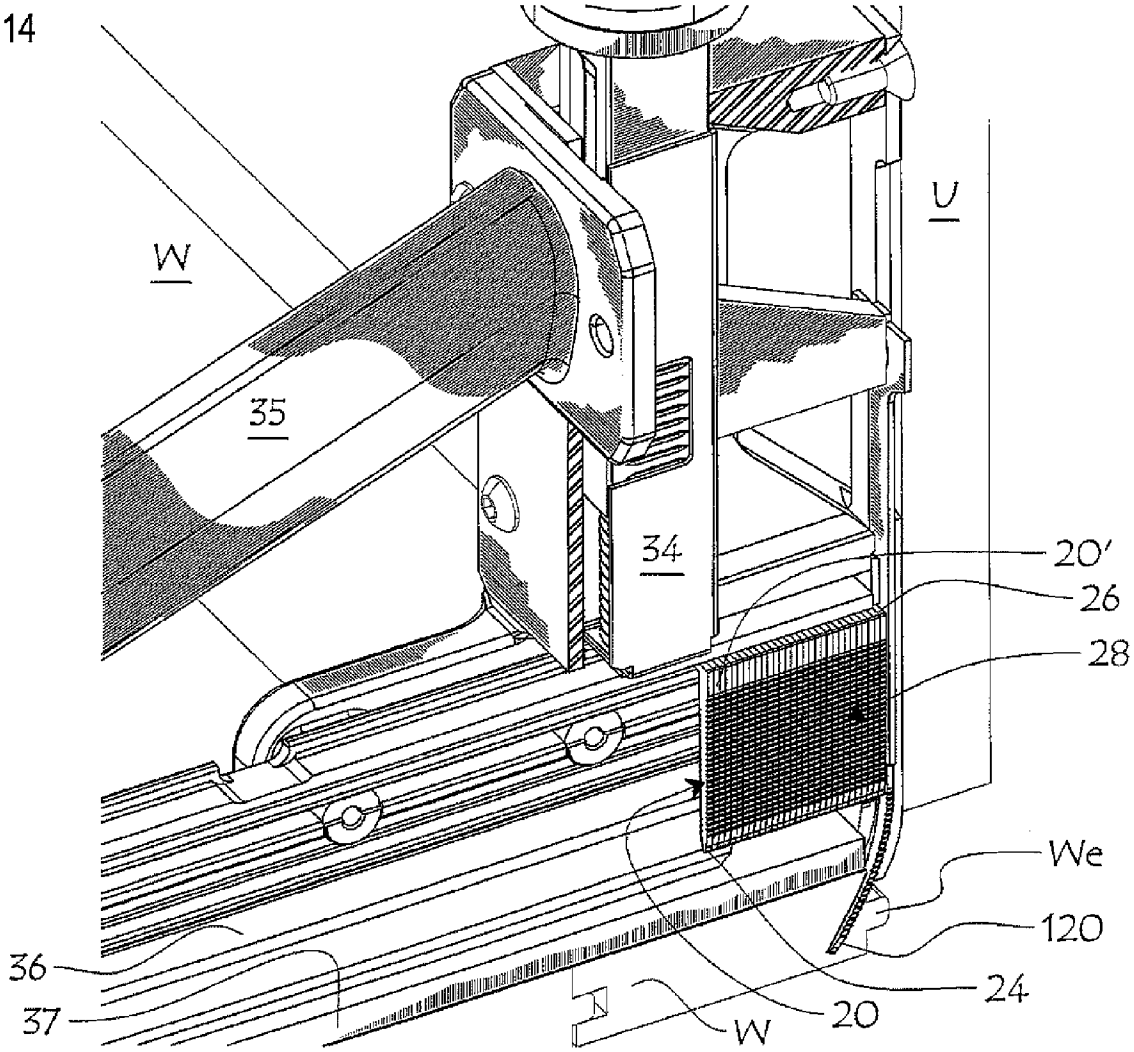
FIG. 14 is an enlarged view of FIG. 9, and further showing some elements in sectional view.

FIG. 14 shows one example of a nail, 20, for use in manually mallet operated type nailers, and which is used with the nailer of the present invention. In front elevation, nail 20 has an elongated body 22 which tapers to a pointed tip portion 24, and has a flat head 26 at an elbowed end portion of the nail body 22, opposite the pointed tip portion 24. Elbowed head 26 must be preferably perpendicular to the elongated body 22, for best performance. More particularly, nail 20 is elbowed at its upper end portion to form the perpendicularly extending flat head 26, nail 20 thus generally being for example L-shaped. Nail 20 has a generally flat body 22, and is transversely much thinner in edge view, than in the front elevation.

A number of nails 20 can be serially linked by flatly successively abutting the nails on their flat surfaces and attaching them by means of known frangible joints, to form a planar nail cartridge 28 of known configuration. The nail cartridge made from a plurality of such L-shaped nails can be loaded into a nailer, for allowing the nails to be successively detached and used one at a time.

Figure 1:
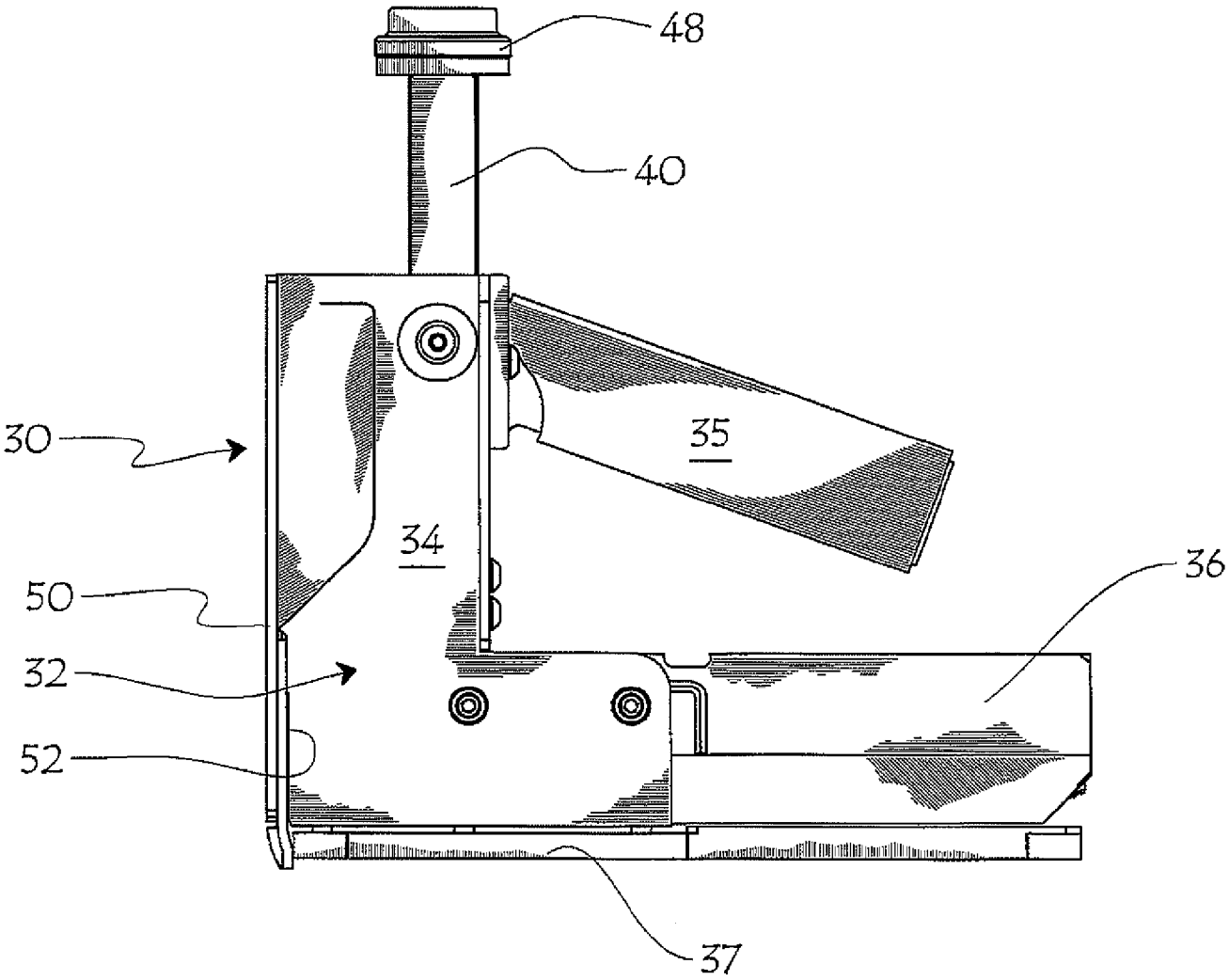
FIGS. 1 and 2 are side elevational views from two opposite lateral sides of a nailer according to the invention.
Figure 2:
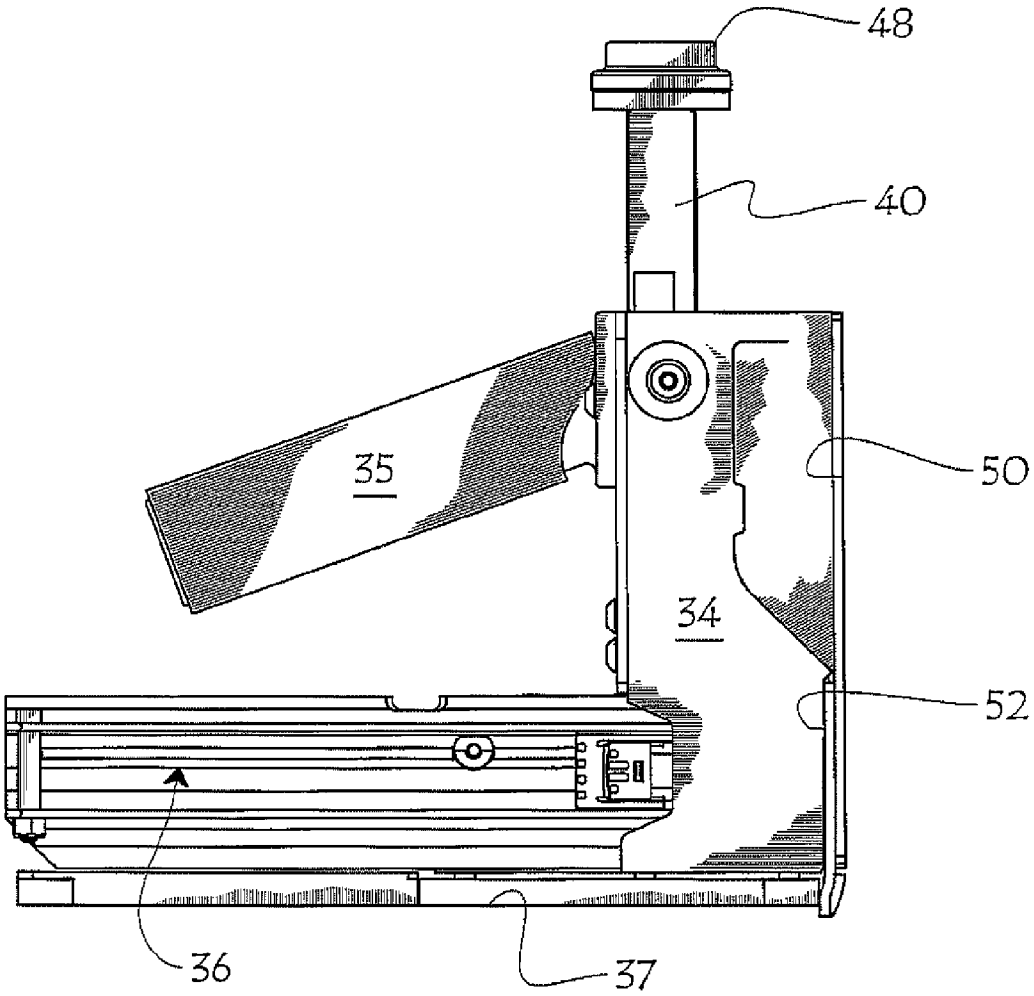
Figure 4:
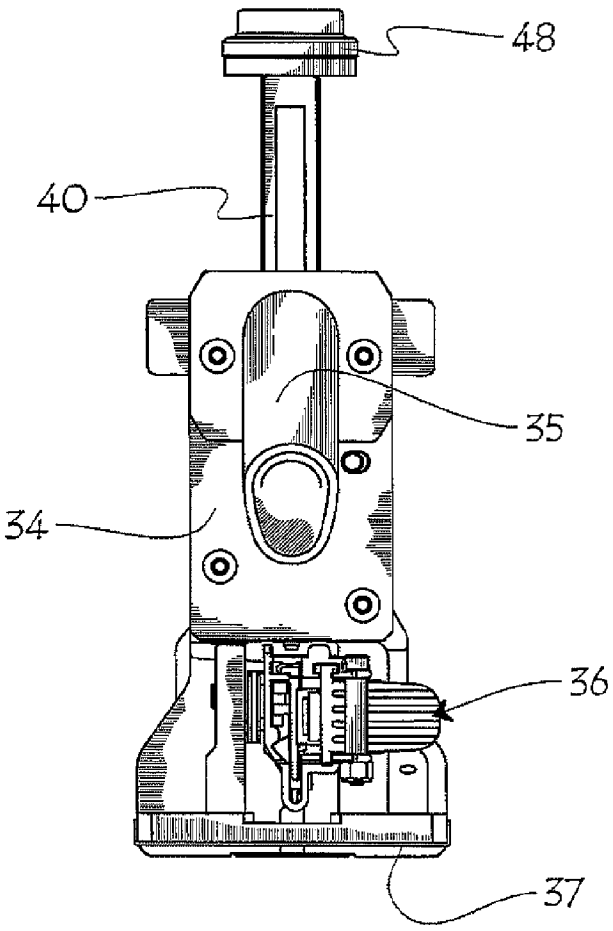
FIGS. 3 and 4 are front and rear elevational views respectively of the nailer of FIG. 1.
Figure 3:
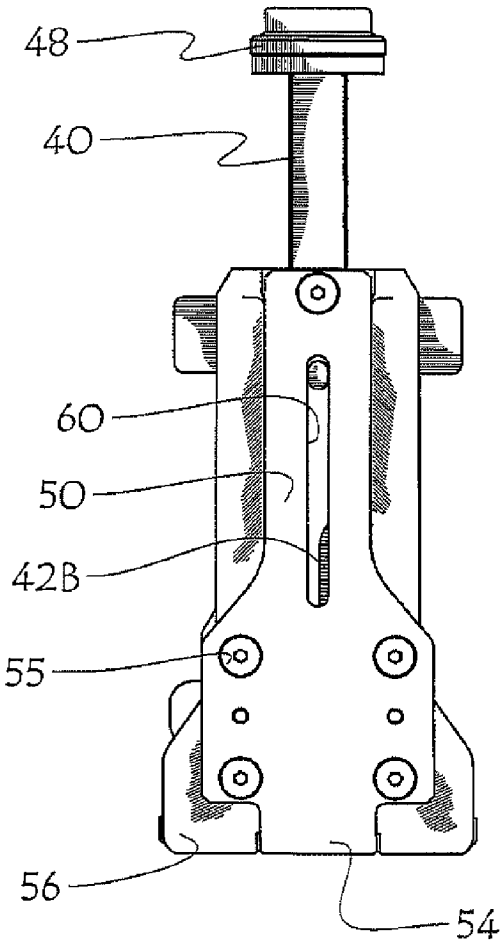
Figure 6:
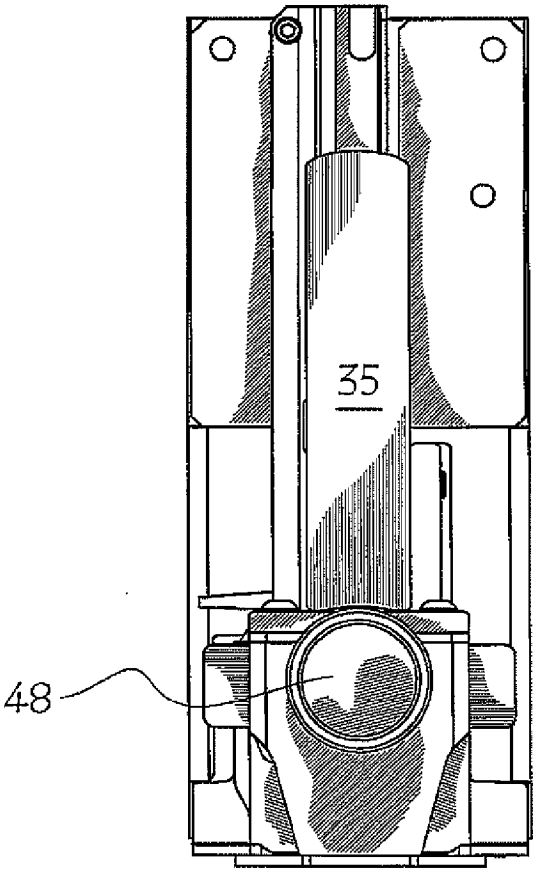
FIGS. 5 and 6 are bottom and top end views respectively of the nailer of FIG. 1.
Figure 5:
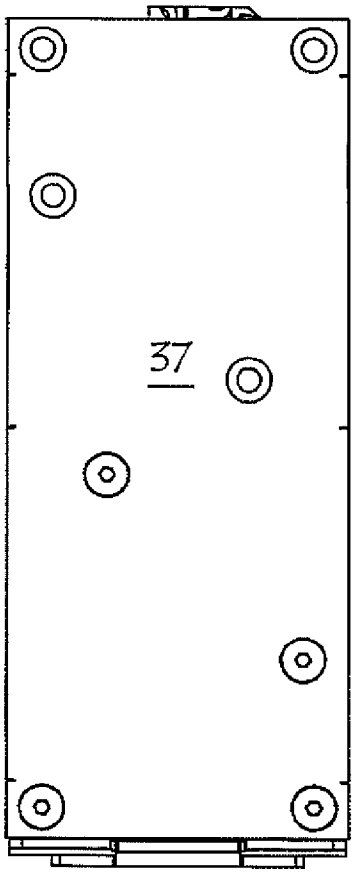
Figure 7:
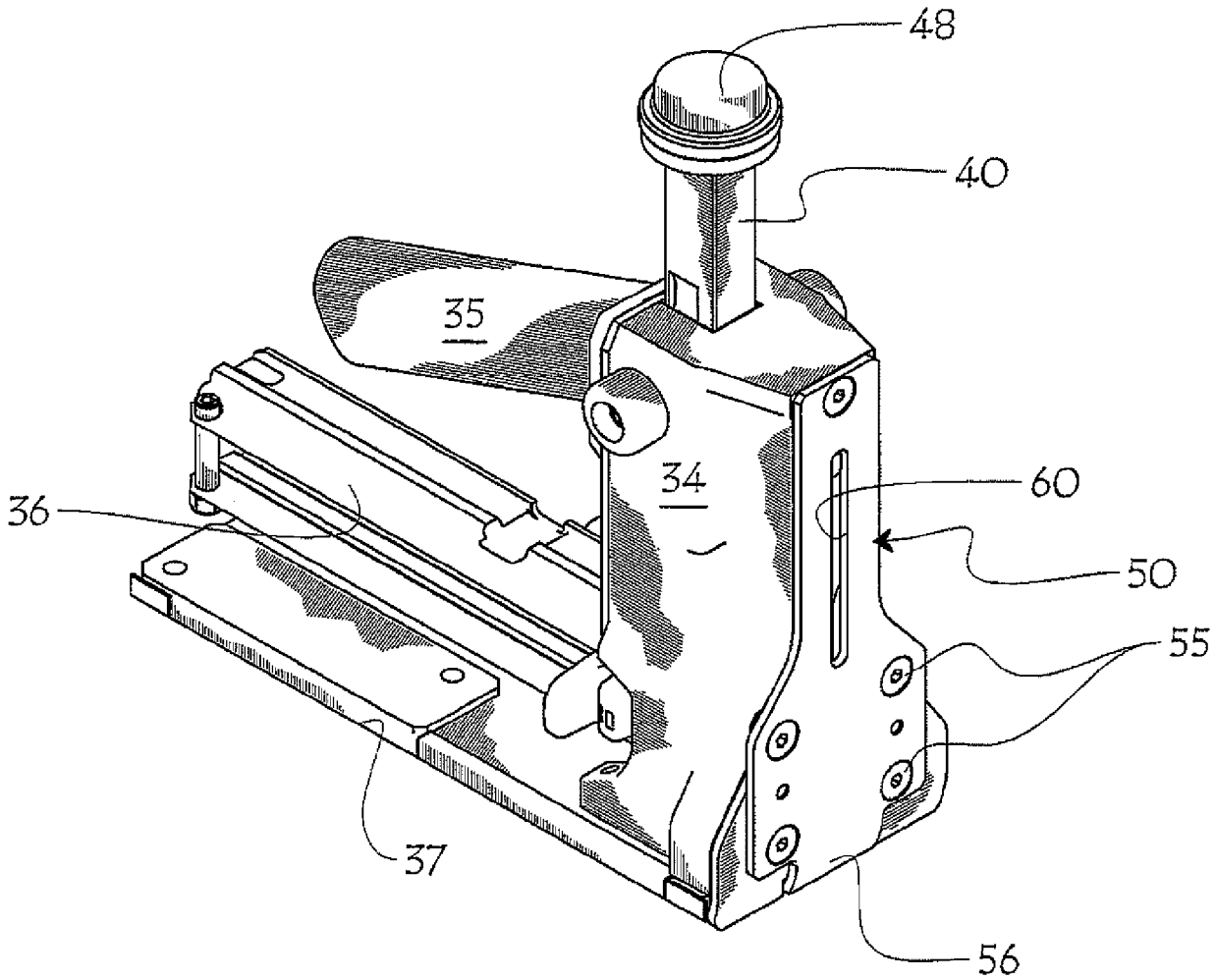
FIGS. 7 to 10 are perspective views from four different perspectives of the nailer of FIG. 1.
Figure 8:
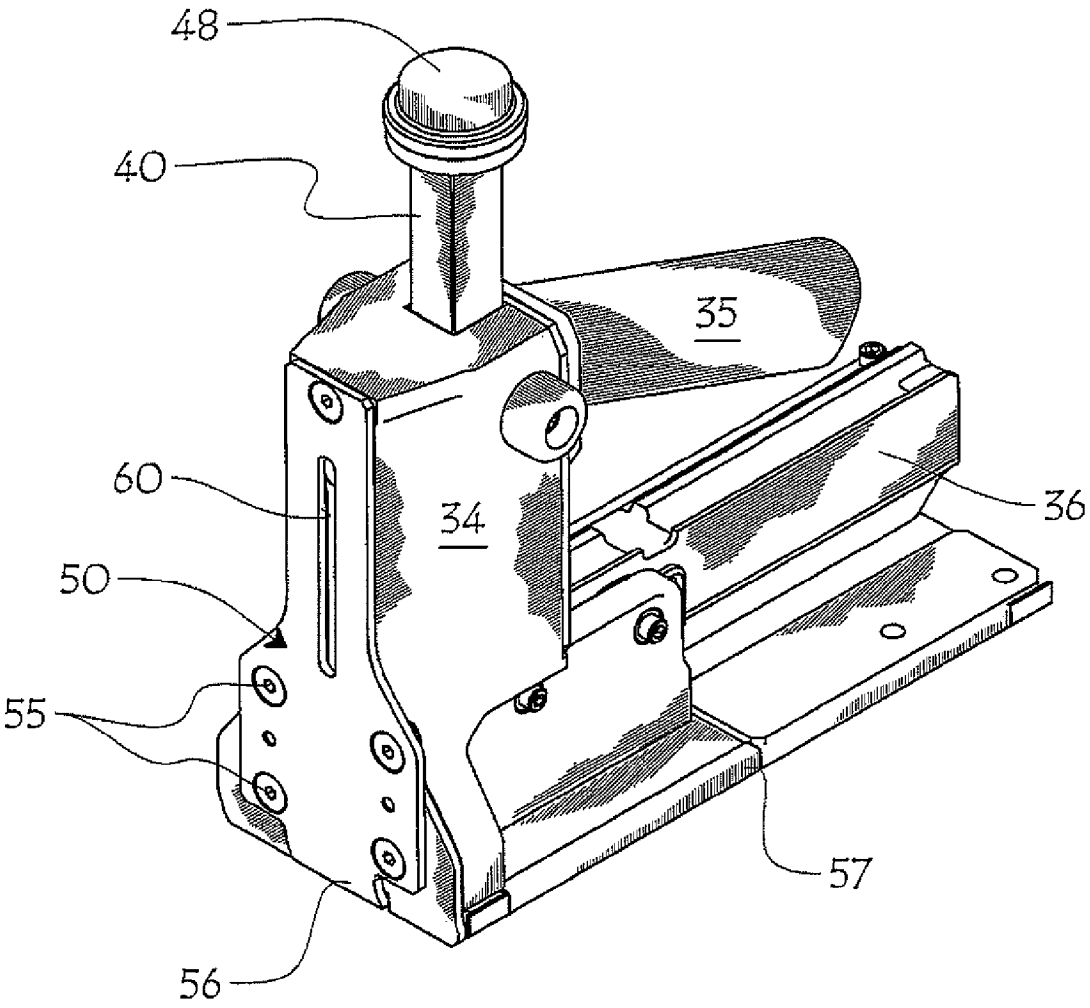
Figure 9:
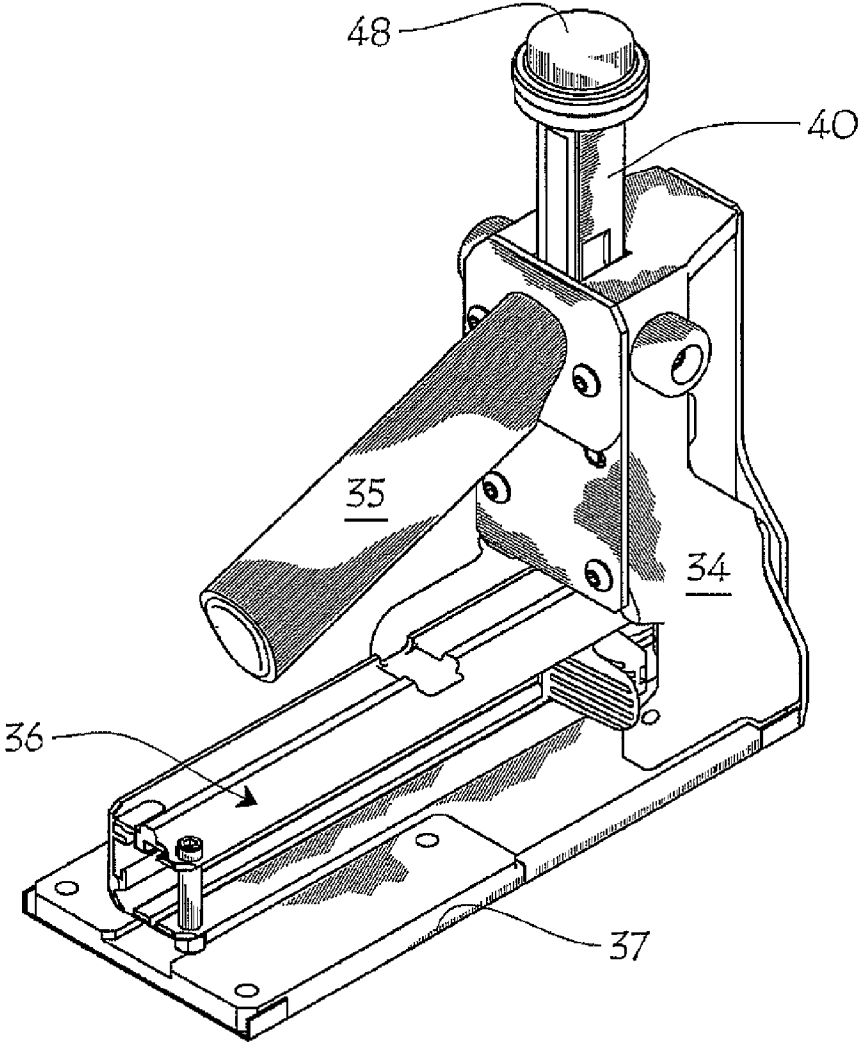
Figure 10:
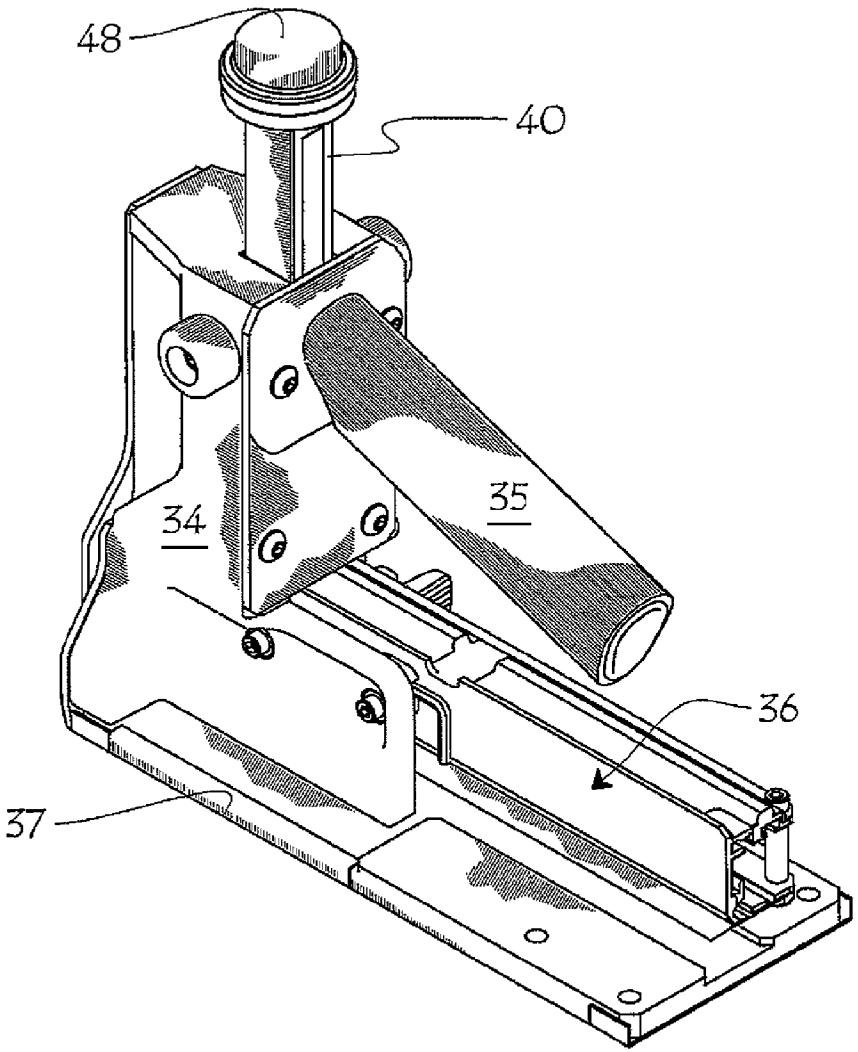
Figure 11:
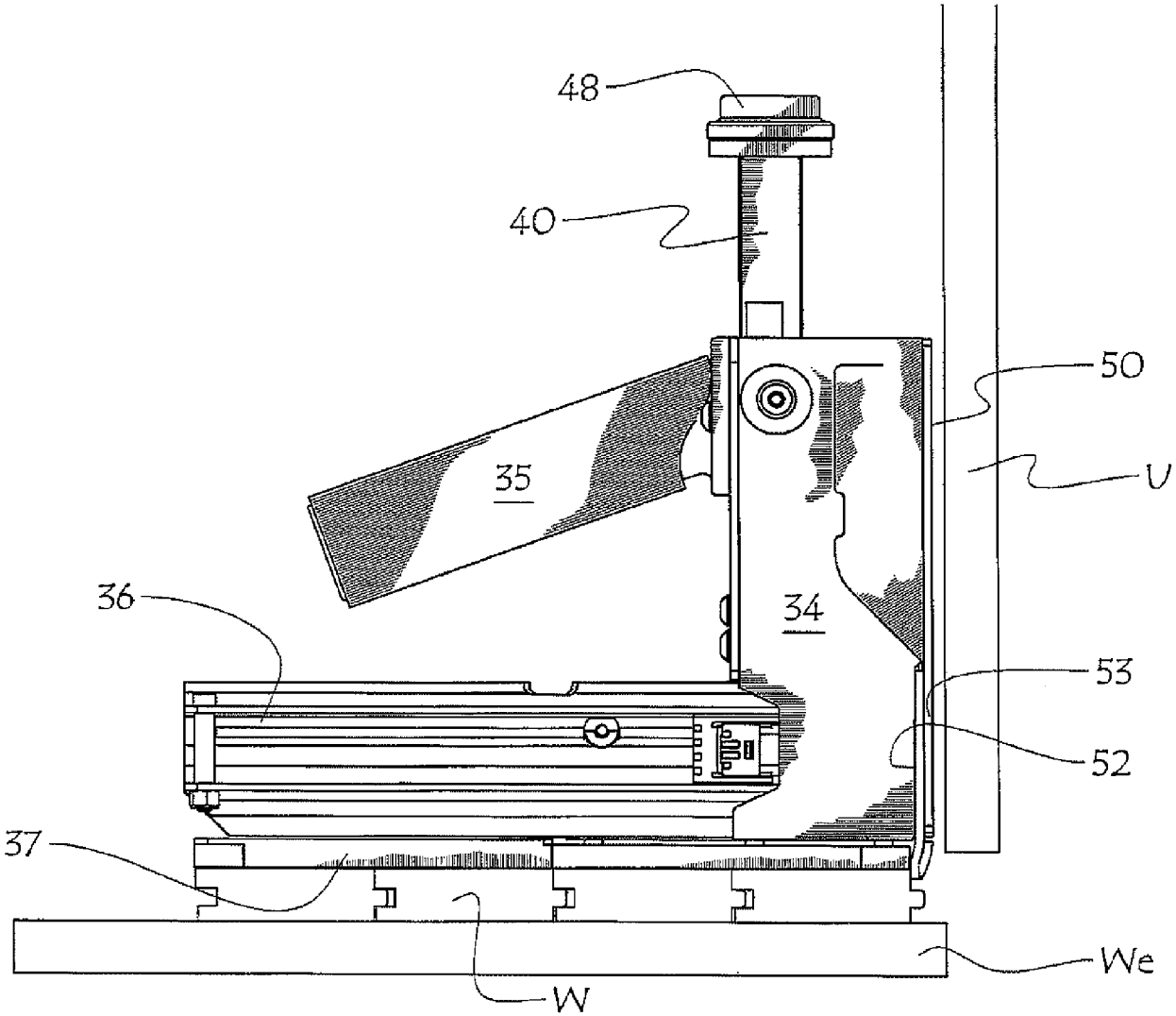
FIG. 11 is a view similar to FIG. 2 but with the nailer in partly sectional view and shown nested into a corner of a room over a plank flooring.
Figure 13:
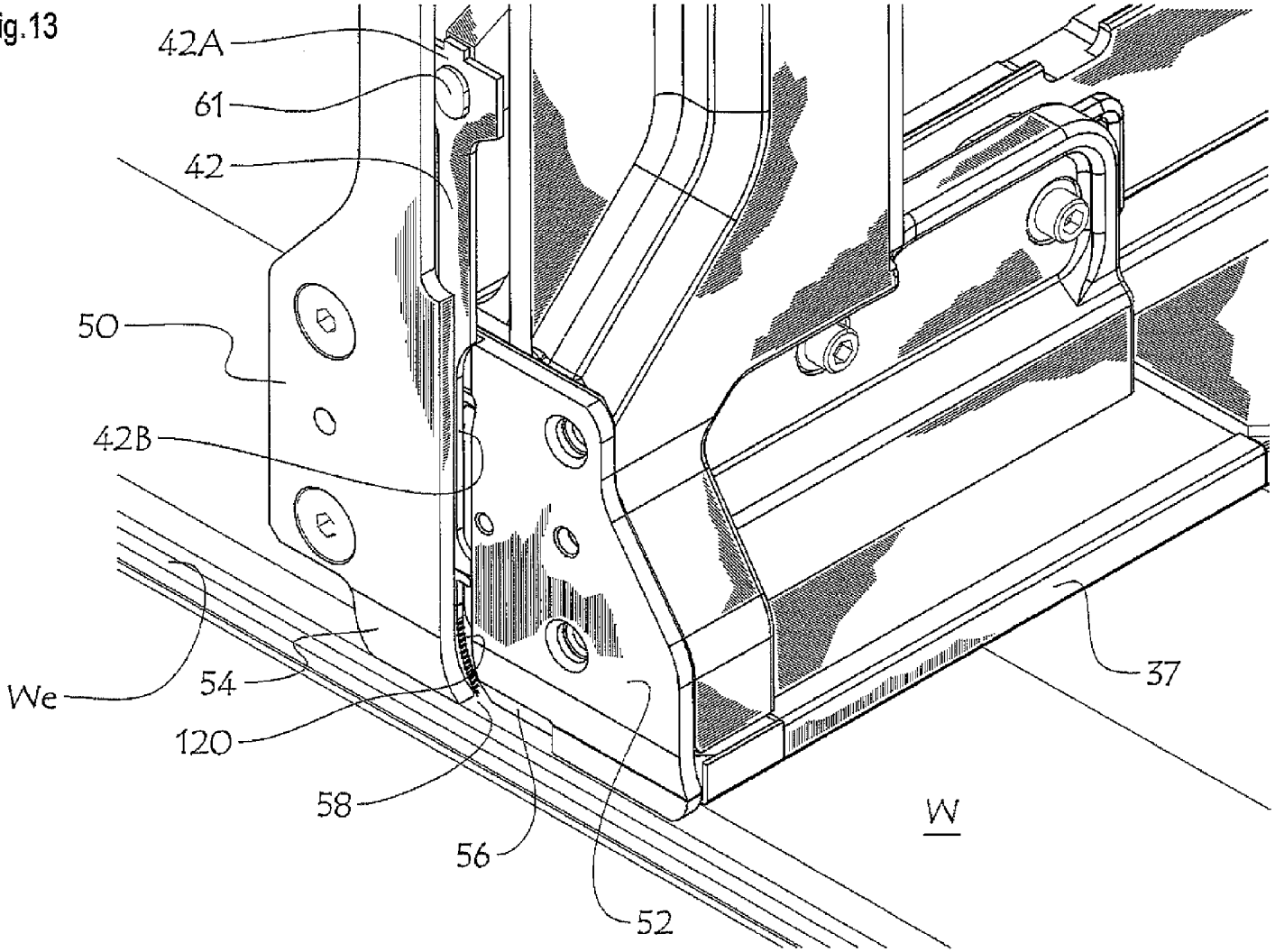
FIG. 13 is an enlarged front perspective view of the head of nailer of FIG. 1, shown overhanging a wooden flooring, and with the front guiding plate partly removed for clarity of the view.

FIGS. 1 to 8 show a nailer 30 according to the invention, comprising a main rigid frame body 32 having an upright column 34, a transverse, rearwardly extending nail magazine 36, and a flat shoe 37 affixed to the bottom thereof for sliding abutment over a wooden work surface W (FIGS. 11 and 13-14). A handle 35 is fixed over and outwardly of magazine 36, for manually carrying nailer 30 spacedly over ground, and for securely holding nailer 30 against the surface to be nailed.

Figure 12:
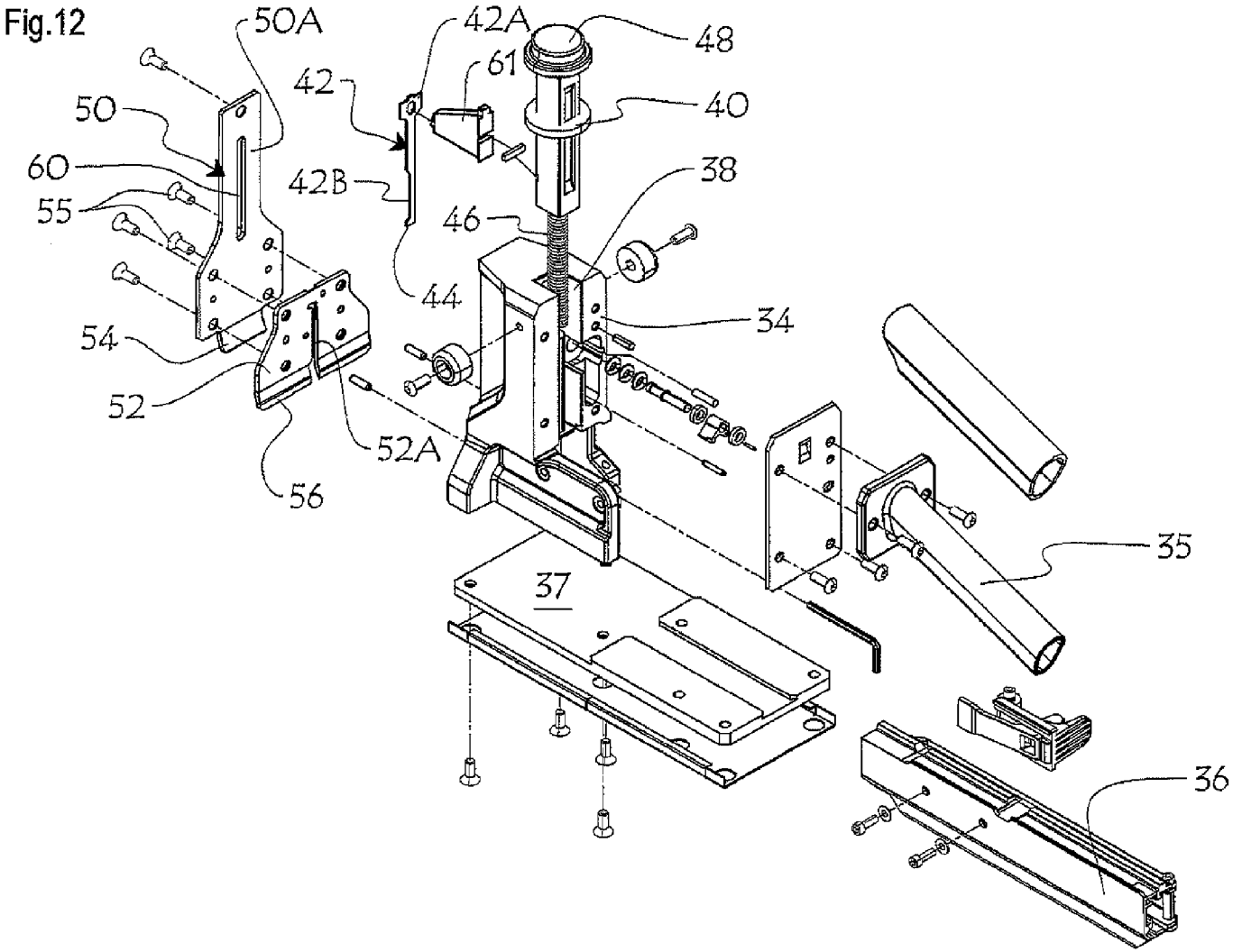
FIG. 12 is an exploded view of the nailer of FIG. 1.

In FIG. 12, column 34 has a vertical chimney 38 therein, in which is vertically slidable a plunger actuator 40 carrying a downwardly-depending flat driver rod 42 defining a horizontally flat, lower abutment edge 44. Plunger actuator 40 is further provided with a coil spring 46 which abuts and is attached at the chimney 38 lower end seat, spring 46 biasing actuator 40 towards an upper resting position. A guiding pole (not shown) may be provided coaxially inside coil spring 46 for guiding the latter, being attached at the lower end seat of chimney 38, and axially engaging a complementary vertical hole extending inside actuator 40. Actuator 40 is guided by chimney 38 in its downward sliding displacement. Upon hitting the upper heel 48 of actuator 40 with a hammer or other suitable device, actuator 40 will be suddenly forcibly downwardly displaced against the bias of spring 46, but at the end of its outward motion, it will move back and it will retrieve its upper resting position under the bias of spring 46 after the blow has been dealt.

The front portion of nailer 30 comprises an elongated front plate 50 and a shorter rear plate 52, all attached to the nailer column 34 by means of guiding pins and bolts 55 extending transversely therethrough, wherein plates 50 and 52 are in spaced register with one another. Plates 50, 52, form guide plates for the fasteners 20. Front plate 50 is shaped and sized to conform to the front of body 34 at its narrower upper portion 50A. A nail ejection channel 53 (FIG. 11) is formed in the gap between guide plates 50 and 52.

Preferably, front plate 50 is forwardly offset relative to the lengthwise plane of actuator plunger 40, to reduce the likelihood of a user accidentally striking adjacent upright wall with user's mallet. Rear plate 52 has a downwardly opening notch 52A, sized and shaped wherein the lower portion of driver rod 42 is slidingly engageable therethrough. The bottom edges of guide plates 50, 52, each form a rearwardly downwardly inclined arcuate flange 54, 56, respectively, complementary to one another and a nail ejection mouth 58 being defined at the bottom end of notch 52A between flanges 54 and 56, through which nails are to be expelled away from nailer 30. Flanges 54, 56, are in spaced register with one another and form together an anvil member, which will bias the nail 20 to tilt away from the original driving axis of drive rod 42, as will be detailed hereinbelow.

Upper portion 52A of front guide plate 50 includes an ovoidal slot 60, guidingly receiving a transverse coupling element 61 integral to the top enlarged integral ear 42A of driver rod 42. Driver rod 42 further defines a thinner lower portion 42B, between wider main portion 42 and enlarged bottom end portion 44.

FIGS. 15 to 18 sequentially show a nail being expelled out from nailer 30. The frontmost nail 20 of the nailer magazine 36 is vertically supported by its frangible joint attachment to the rearwardly adjacent nail 28' (FIG. 14) of the nail cartridge 28 located in the magazine 36.

Figure 15:
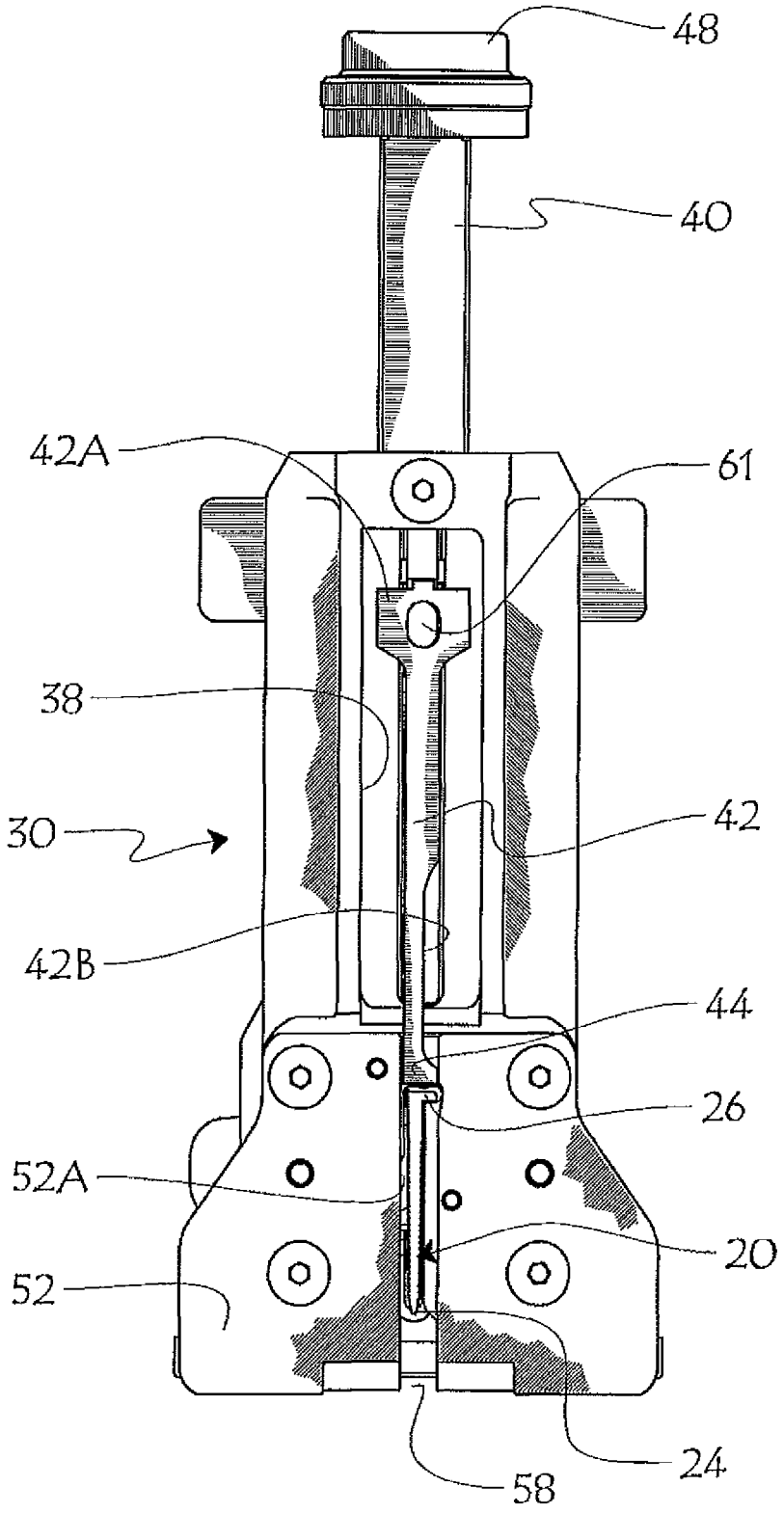
FIGS. 15 to 18 are views similar to FIG. 3 but at an enlarged scale and with the front guide plate being removed for improved clarity of the push rod, fastener and fastener channel.
Figure 16:
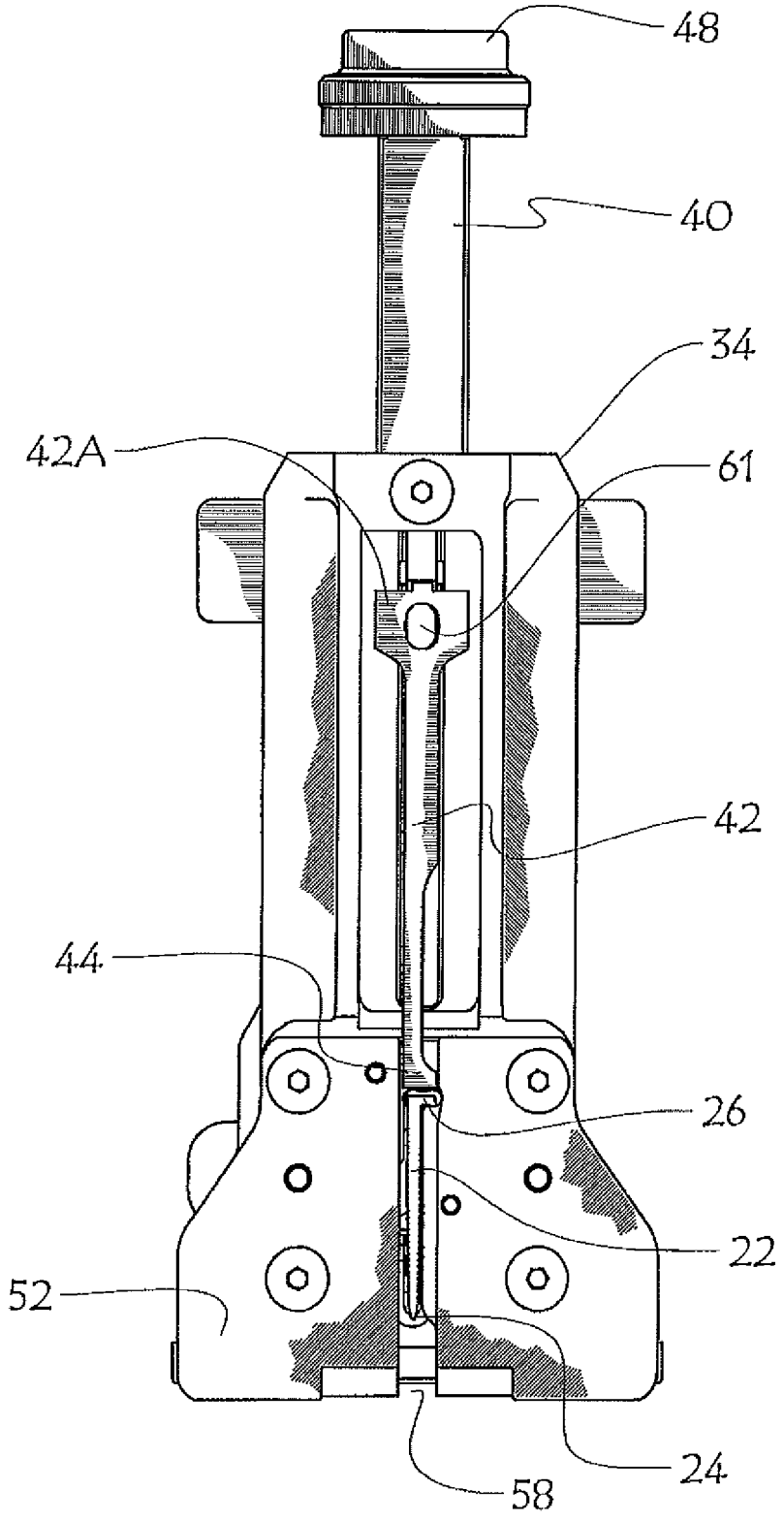
Figure 17:
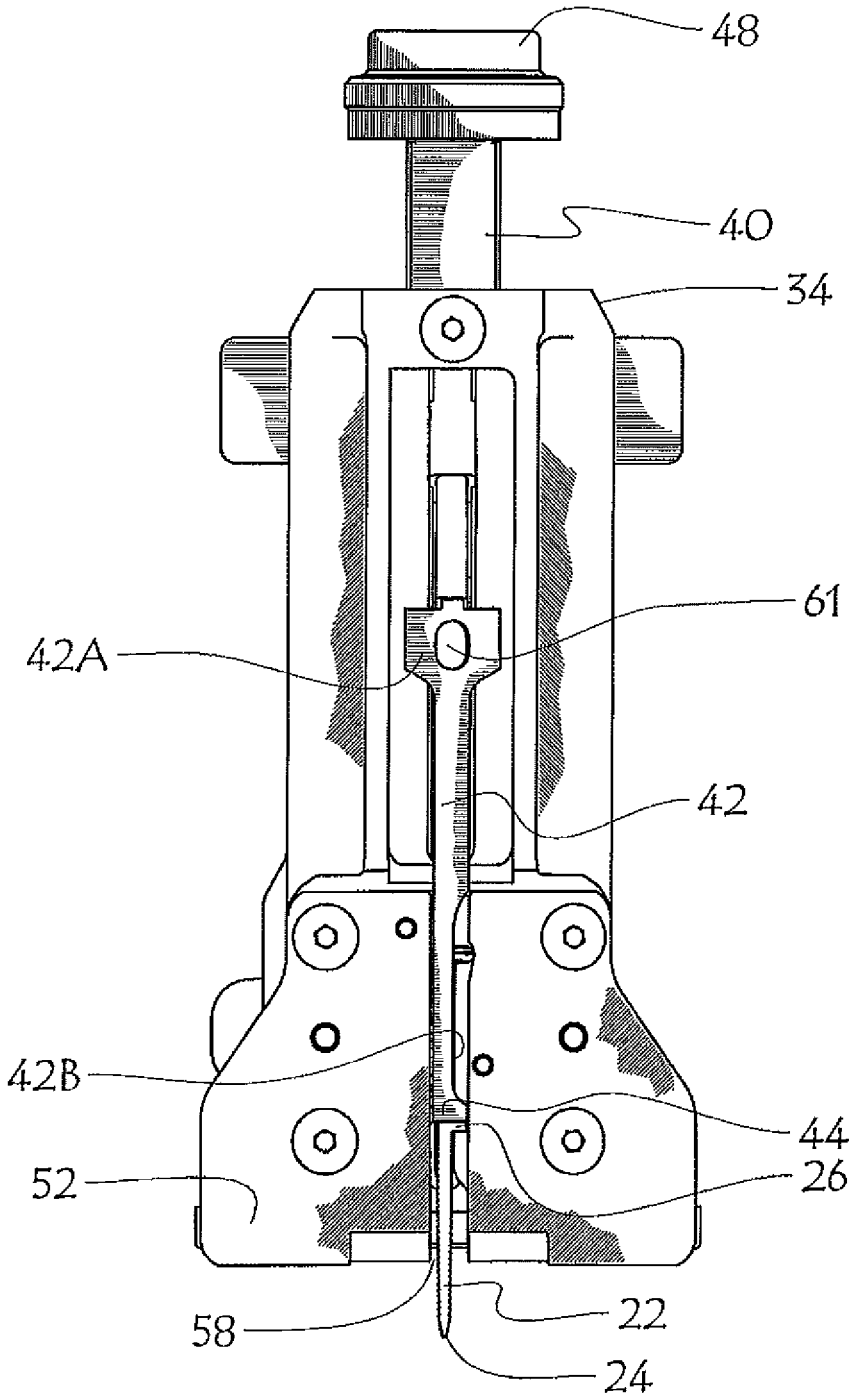
Figure 18:
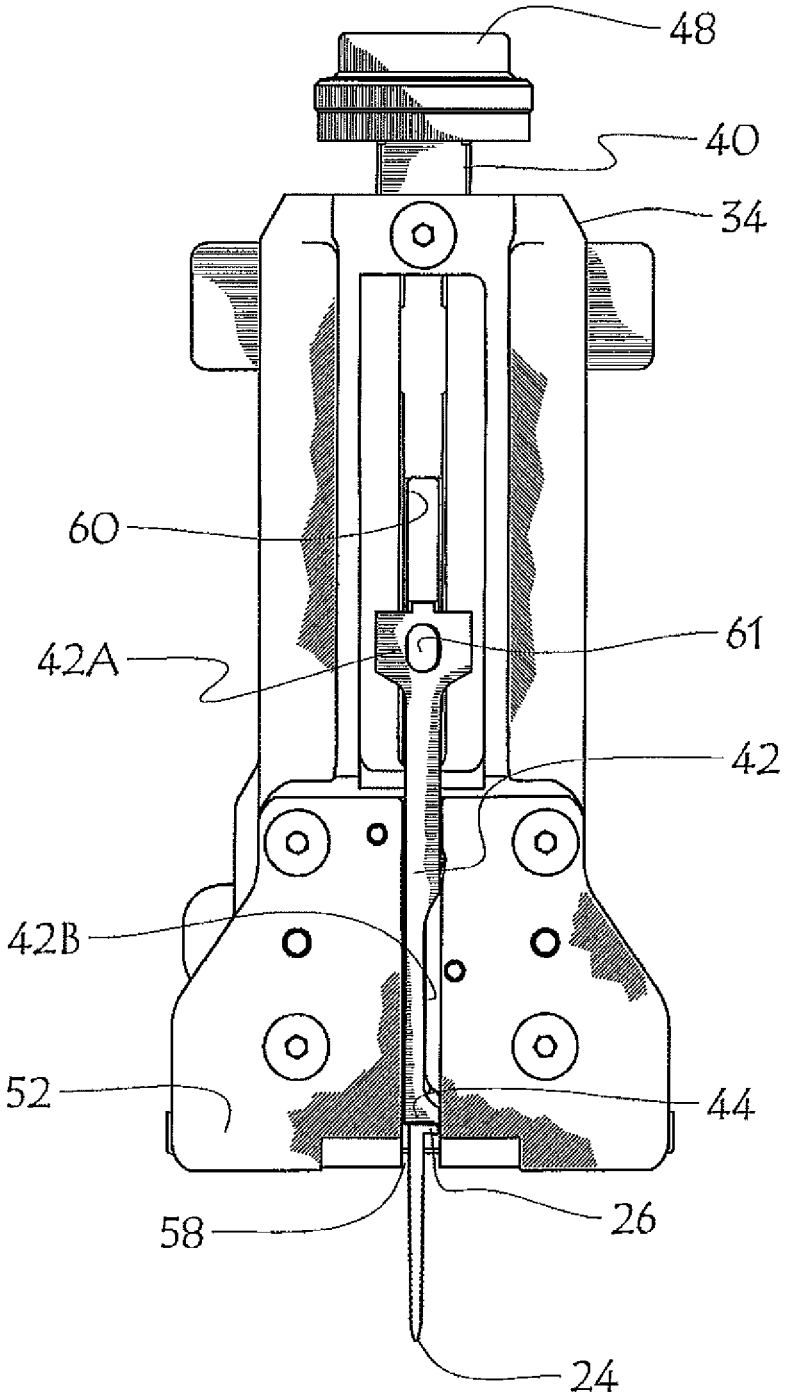

In use, the lead nail 20 of the nail cartridge 28 is initially located and positioned as shown in FIG. 15, i.e. biased into abutment against front plate 50 and vertically positioned spacedly under driver rod bottom end 44 and spacedly over fastener ejection mouth 58. Upon forcibly hitting the heel 48 of the plunger actuator 40, driver rod 42 is downwardly driven and flatly impacts with its flat bottom abutment end 44 against the flat top head 26 of nail 20, for downwardly driving nail 20, as shown in FIGS. 16-18. Since the adjacent nail 20' to lead nail 20 of nail cartridge 28 downwardly rests with its head 26 on the main body of magazine 36, it will not be downwardly carried with the frontmost nail 20, the frangible joint between the two nails being ruptured upon impact from driver rod 42 on the frontmost leading nail 20.

As the nail 20 and driver rod 42 move downwardly coaxially with the longitudinal axis of plunger actuator 40, the nail bottom tip 24 will come to eventually engage with flange 54. The bottom portion of nail 20 will thereafter become deflected laterally away from the main body of guide plate 50 and towards registering guide plate 52. Driver rod 42 will move downwardly therewith, with the driver rod head 42A slidingly mounted for relative movement to ovoidal slot 60 by connector 61. As laterally deflected nail 20 moves further downwardly, the lower thinner recess section 42B of driver rod 42 will also become laterally deflected and will transversely engage through registering notch 52A of guide plate 52 to follow the offset ejected travel axis of nail 20, i.e. diverging off axis relative to said longitudinal axis of plunger actuator 40, while the upper larger section of driver rod 42 remains within said longitudinal axis of actuator 40.

It is thus understood that during successive ejections of nails, plunger actuator 40 will remain axially aligned at all times, while driver rod 42 will tilt in oscillating like fashion about its lower end portion 42B. That is to say, the upper end portion 42A of driver rod 42, being mounted for relative movement by connector mount 61 to the lower end of actuator 40, will remain axially aligned with actuator 40, while the lower end portion 42B of driver rod 42 will swing back and forth in reciprocating fashion relative to large plate 50 with successive nails ejections. The change in travelling direction of the lower portion 42B of driver rod 42 occurs only at the level of the nail ejection mouth 58, not inside the inner nail ejection channel 53 leading to this mouth 58. In other words, the travelling direction of driver rod 42 and associated nail 20 is arcuate for only a fraction of the total travel thereof; there is a first travelling segment which is axially straight, and then there is a second travelling segment which is translational (with tilting motion) but only for the lower portion thereof.

It is clearly seen in the sequence of FIGS. 15-18 that the lower end 44 of driver rod 42 constantly remains in contact with smaller guide plate 52, within channel 52A. In one embodiment, drive rod lower portion 44 remains guided by channel 52A for about 80% of the travelling distance thereof, while it becomes tilted for the remainder 20% of travel thereof.

However, when drive rod lower portion 44 reaches the flange 56 of guide plate 52, the recess 42B of drive rod 42 enables the latter to clear the channel 53 between guide plates 50, 52, and to transversely engage into guide plate notch 52A.

It is noted that no spring biasing means is required for enabling and sustaining swinging motion of the lower portion of drive rod 42.

As suggested in FIGS. 13 and 14, arcuate deformation of the originally straight nail 20 into a curved nail 120 may occur, under buckling forces. These buckling forces may be independent of resistance loads from the underlying wooden work surface, i.e. transverse loads born solely by the nail 20 engaging bottom flanges 54, 56 of lower guide plates 50, 52, are sufficient to curve the originally straight nail.

FIG. 14 suggests how the nailer 30 can be operated with its front end 50 abutting directly against an upright wall U, with the leading nail 120 having been deflected rearwardly downwardly away from the plane of upright wall U into the underlying wooden work surface W. This way, the curved ejected nail 120 will become engaged into a work surface portion spacedly away from the more brittle edge portion We thereof in register with the upright wall U.

It is understood that the nailer 30 of the present invention has been described for nailing floor boards to a subfloor, but it could be used to nail any suitable wall surface. The present nailer 30 is particularly efficient in getting very close to or directly against an upright obstacle, without compromising nailing efficiency for a subjacent work piece.

Also, the nailer 30 has been shown with a nail-driving anvil member or plunger actuator 40, although it is understood that the driver rod 42 could be propelled with any selectively actuated power means, such as a hydraulic power device, for example.

The nailer head or heel portion 48 also may comprise a ring having a larger diameter than plunger actuator 40, this ring coming into downward vertical abutment with the upper surface of the upright column of nailer 30, to limit actuator 40 to a downward limit position.

Any other modifications, which do not deviate from the scope of the present invention, are considered to be included therein. For example, in one embodiment, the manual plunger actuator 40 could be replaced by the main piston shaft of a pneumatic type nailer.

While certain representative embodiments and details have been shown for purposes of illustrating the invention, it will be apparent to those skilled in the art that various changes may be made without departing from the scope of the disclosure, which is further described in the following appended claims.

What is claimed is:

1. A nailer for securing planks to a subfloor or other structure in tight places using fasteners, said nailer comprising:

a main body defining a fastener discharge mouth;

fastener ejection means operatively mounted in said nailer main body for accommodating passage of a fastener, the fastener having a head at one end and an opposite tip, said fastener ejection means opening outwardly of said nailer at said fastener discharge mouth;

an elongated straight push rod, defining an inner end thereof operatively mounted to said fastener ejection means, and defining an outer end portion thereof for freely axially engaging the fastener head, said push rod movable between first and second limit positions, including an intermediate position between said first and second limit positions;

wherein said push rod moves rectilinearly between said first and intermediate positions thereof but said push rod outer end portion tilts laterally away when moving in a non-rectilinear fashion between said intermediate and second limit positions thereof;

and a plunger actuator nested in said main body and operatively connected to said inner end portion of said push rod, wherein said plunger actuator can be selectively activated for moving said push rod between its said first and second limit positions;

wherein upon activation of said plunger actuator, said push rod will move along said fastener ejection means from said first limit position towards said second limit position to forcibly strike the fastener head, wherein between said intermediate position and said second limit position, the push rod outer end portion will be ejected out of said nailer through said fastener discharge mouth and into a subjacent workpiece;

wherein said fastener ejection means consists of a fastener ejection channel made in said nailer main body, said fastener ejection channel being formed in between a pair of registering first and second guide plates spacedly mounted parallel to one another for accommodating therebetween passage of a fastener, said first guide plate defining a planar first intermediate section and a planar inner end portion having a lengthwise slider mounting means and an outer end portion defining an arcuate first flange crossing the plane of said first intermediate section, said second guide plate defining a planar second intermediate section having an outer end portion defining an arcuate second flange crossing the plane of said first main body away from said first guide plate and generally parallel to said first flange; said elongated straight push rod partially nested at an inner end thereof in said fastener ejection channel slider mounting means, said push rod movable along said fastener ejection channel between first and second limit positions;

a lengthwise notch further extending along said second guide plate intermediate section and opening into said second flange and sized and shaped to accommodate transverse passage of said outer end portion of said push rod, wherein said push rod outer end portion tilts laterally away from said first guide plate when moving in said non-rectilinear fashion between said intermediate and second limit positions thereof;

wherein upon activation of said plunger actuator, the push rod outer end portion will become laterally dynamically deflected by said first flange transversely of the plane of said first guide plate intermediate section and will move through said second guide plate notch and will bias the fastener to escape through said fastener discharge mouth to be ejected out of said nailer through said fastener discharge mouth and into a subjacent workpiece.

2. A nailer as in claim 1, wherein said slider mounting means defines an ovoidal slot made into said first intermediate section of said first guide plate, and a slider carriage operatively slidingly mounting said push rod inner end to said ovoidal slot for relative movement thereabout.

3. A nailer for securing planks to a subfloor or other structure in tight places using fasteners, said nailer comprising:

a main body defining a fastener discharge mouth;

a fastener ejection channel made in said nailer main body, said fastener ejection channel being formed in between a pair of first and second registering guide plates spacedly mounted parallel to one another for accommodating therebetween passage of a fastener, the fastener having a head at one end and an opposite tip, said fastener ejection channel opening outwardly of said nailer at said fastener discharge mouth, said first guide plate defining a planar first intermediate section and a planar inner end portion having a lengthwise slider mounting means and an outer end portion defining an arcuate first flange crossing the plane of said first intermediate section, said second guide plate defining a planar second intermediate section having an outer end portion defining an arcuate second flange crossing the plane of said first main body away from said first guide plate and generally parallel to said first flange;

fastener push means, for freely axially engaging the fastener head, and a plunger actuator nested in said main body and operatively connected to said fastener push means;

wherein upon activation of said plunger actuator, said fastener push means will bias the fastener to escape through said fastener discharge mouth to be ejected out of said nailer through said fastener discharge mouth and into a subjacent workpiece.

4. A nailer for securing planks as in claim 3, wherein said fastener push means consists of an elongated straight push rod, partially nested at an inner end thereof in said fastener ejection channel slider mounting means, and defining an outer end portion thereof for freely axially engaging the fastener head, said push rod movable along said fastener ejection channel between first and second limit positions, including an intermediate position between said first and second limit positions;

a lengthwise notch further extending along said second guide plate intermediate section and opening into said second flange and sized and shaped to accommodate transverse passage of said outer end portion of said push rod, wherein said push rod moves rectilinearly between said first and intermediate positions thereof but said push rod outer end portion tilts laterally away from said first guide plate when moving in a non-rectilinear fashion between said intermediate and second limit positions thereof;

said plunger actuator nested in said main body being operatively connected to said inner end portion of said push rod, wherein said plunger can be selectively activated for moving said push rod between its said first and second limit positions;

wherein upon activation of said plunger actuator, said push rod will move along said fastener ejection channel from said first limit position towards said second limit position to forcibly strike the fastener head, wherein between said intermediate position and said second limit position, the push rod outer end portion will become laterally dynamically deflected by said first flange transversely of the plane of said first guide plate intermediate section and will move through said second guide plate notch and will bias the fastener to escape through said fastener discharge mouth to be ejected out of said nailer through said fastener discharge mouth and into a subjacent workpiece.

5. A nailer as in claim 4, wherein said slider mounting means defines an ovoidal slot made into said first intermediate section of said first guide plate, and a slider carriage operatively slidingly mounting said push rod inner end to said ovoidal slot for relative movement thereabout.

6. Use of a nailer for securing hardwood flooring planks to a subfloor in tight places using fasteners, said nailer comprising:

a main body defining a fastener discharge mouth;

a fastener ejection channel made in said nailer main body, said fastener ejection channel being formed in between a pair of first and second registering guide plates spacedly mounted parallel to one another for accommodating therebetween passage of a fastener, the fastener having a head at one end and an opposite tip, said fastener ejection channel opening outwardly of said nailer at said fastener discharge mouth, said first guide plate defining a planar first intermediate section and a planar inner end portion having a lengthwise slider mounting means and an outer end portion defining an arcuate first flange crossing the plane of said first intermediate section, said second guide plate defining a planar second intermediate section having an outer end portion defining an arcuate second flange crossing the plane of said first main body away from said first guide plate and generally parallel to said first flange;

an elongated straight push rod, partially nested at an inner end thereof in said fastener ejection channel slider mounting means, and defining an outer end portion thereof for freely axially engaging the fastener head, said push rod movable along said fastener ejection channel between first and second limit positions, including an intermediate position between said first and second limit positions;

a lengthwise notch further extending along said second guide plate intermediate section and opening into said second flange and sized and shaped to accommodate transverse passage of said outer end portion of said push rod, wherein said push rod moves rectilinearly between said first and intermediate positions thereof but said push rod outer end portion tilts laterally away from said first guide plate when moving in non-rectilinear fashion between said intermediate and second limit positions thereof;

and a plunger actuator nested in said main body and operatively connected to said inner end portion of said push rod and movable along an axial channel defining a direction of displacement thereof, wherein upon actuation of said plunger actuator, said plunger actuator moves said push rod between its said first and second limit positions, and said push rod forcibly strikes the fastener head, wherein between said intermediate position and said second limit position, the push rod outer end portion becomes laterally dynamically deflected by said first flange transversely of the plane of said first guide plate intermediate section and moves through said second guide plate notch and biases the fastener to escape through said fastener discharge mouth to be ejected out of said nailer through said fastener discharge mouth and into a subjacent workpiece.

7. Use of a nailer as in claim 6, wherein said fastener is ejected through said fastener ejection channel in a direction diverging from said axial channel direction of displacement of said plunger actuator.

* * * * *